United States Patent [19]

O'Connor

[11] Patent Number: 4,976,208

[45] Date of Patent: Dec. 11, 1990

[54] WATER COOLED INCINERATOR

[76] Inventor: Chadwell O'Connor, 2024 Galazy Dr., Newport Beach, Calif. 92660

[21] Appl. No.: 444,661

[22] Filed: Dec. 1, 1989

[51] Int. Cl.[5] ..... F23B 7/00

[52] U.S. Cl. ..... 110/234; 110/247; 110/256; 122/2

[58] Field of Search ..... 122/2, 20 B, 19, 15, 122/18; 110/247, 234, 256

[56] References Cited

U.S. PATENT DOCUMENTS

| | | | |
|---|---|---|---|
| 647,432 | 4/1900 | Whedon | 110/247 |
| 1,724,352 | 8/1929 | Ilving | 110/247 |
| 2,402,436 | 6/1946 | Nichols | 110/247 |
| 3,404,643 | 10/1968 | Ankerson | 110/247 |
| 3,611,542 | 10/1971 | Moore | 110/247 |
| 3,680,503 | 8/1972 | Danielsson et al. | 110/247 |
| 3,822,651 | 7/1974 | Harris et al. | 110/234 |
| 4,023,508 | 5/1977 | Cantrell, Jr. et al. | 110/234 |
| 4,349,354 | 9/1982 | Flesch | 110/234 |
| 4,555,993 | 12/1985 | Gallaro | 110/234 |
| 4,655,146 | 4/1987 | Lemelson | 110/247 |
| 4,846,082 | 7/1989 | Marangoni | 110/247 |
| 4,876,971 | 10/1989 | O'Connor | 110/234 |

*Primary Examiner*—Edward G. Favors
*Assistant Examiner*—Denise L. F. Gromada
*Attorney, Agent, or Firm*—Leydig,Voit & Mayer

[57] ABSTRACT

An incinerator having a horizontal burn disk which is rotatably supported within the lower portion of a firebox with a portion of the firebox containing water tubes connected to a water circulation system including a header and a steam drum. Compacted material for burning is gravity fed to the burn disk througha vertical feeding chute of sufficient height to effect the compaction. Combustion air is forced into the burning material through stationary nozzles disposed about the periphery of the disk, and a nozzle stationary nozzle extending up through the center of the disk.

21 Claims, 1 Drawing Sheet

WATER COOLED INCINERATOR

BACKGROUND

Figure 1:
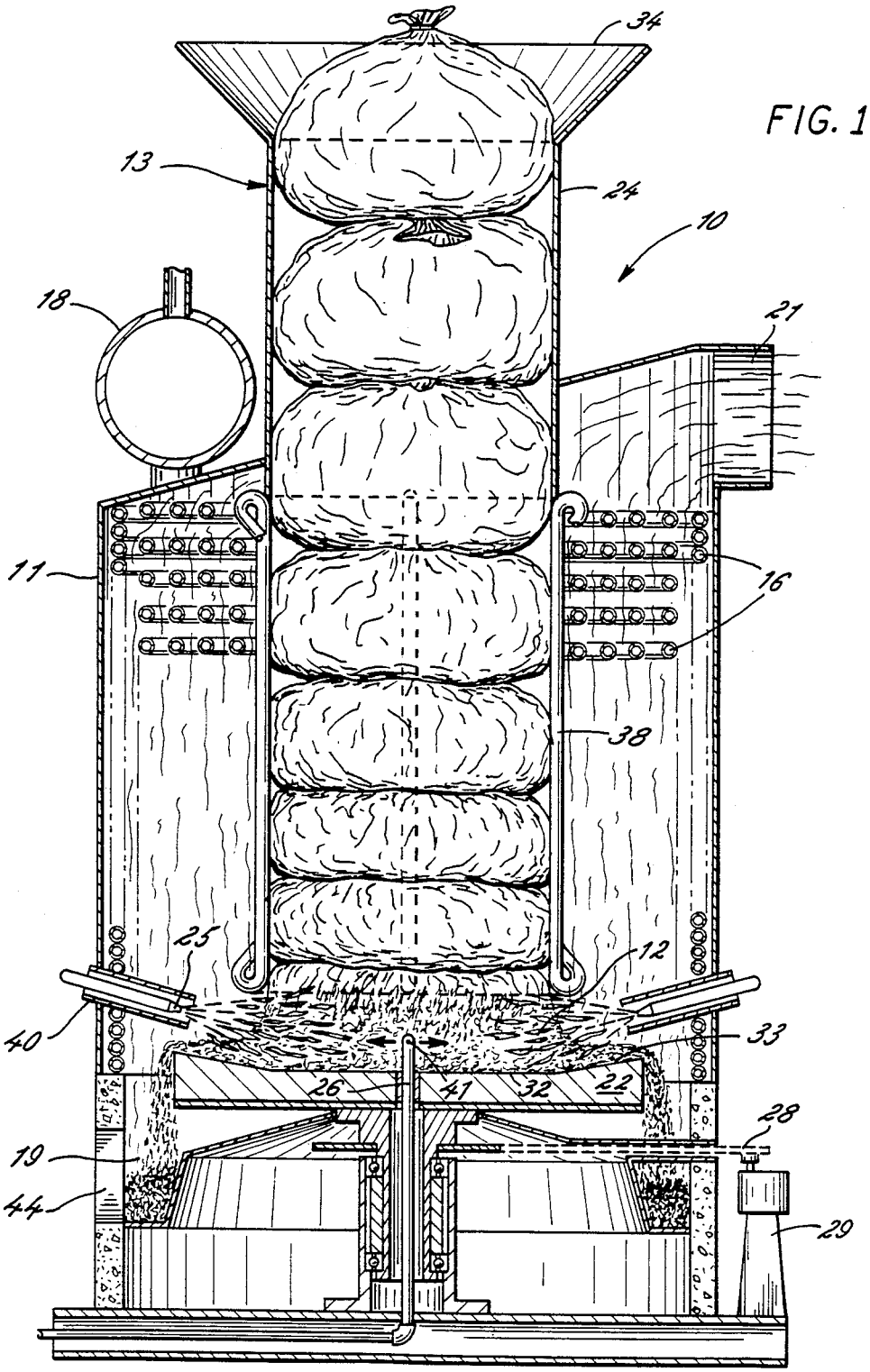

This invention relates generally to incinerators and more particularly concerns a small volume, water-cooled rotary incinerator.

U.S. Pat. No. 3,822,651, issued July 9, 1974, discloses a form of incinerator that has been become known as a combustor. Such combustors burn municipal waste in rotary, water cooled drums; with the cooling water system generating steam for direct use for power generation. Combustors of this type have proven effective for large volume incineration, on the order of over 100 tons of material per day. While these designs have generally not been suitable for scaling down for low volume usage, I have also invented another small volume water-cooled rotary incinerator, which is the subject of U.S. Pat. No. 4,876,971, issued Oct. 31, 1989.

Waste disposal of all kinds has become a critical concern, and there is a need for an incinerator suitable for hospital or small industry use that can dispose of material at rates less than 25 tons per day. Further, certain applications may present special problems due to the particular characteristics of the waste to be disposed. For example, contaminated waste from hospitals may contain disease and germ carrying liquids and solids, as well as other miscellaneous items, such as dirty needles, which may transmit contagious diseases. The problem of hospital waste disposal has become particularly acute due to infection problems associated with the AIDS virus.

Although this type of waste must be bagged in specially-coded bags, problems can arise if the bags are mishandled or punctured. As a result of the above concerns, mechanical loading methods, such as those using ram feeds, may be inappropriate for use in loading hospital incinerators because they may squeeze the bag or other waste holding container, resulting in the release of contaminated liquids and solids. Moreover, inasmuch as mechanical rams operate at room temperature, these contaminated liquids and solids may not be burned off during the normal incineration process and, accordingly, may present health risks associated with regular loading and system maintenance.

Accordingly, it is an object of the invention to provide a small compact incinerator that efficiently burns a wide variety of combustible material. It is a related object to provide an incinerator of this kind that is water cooled and capable of generating steam for useful energy. A further object is to provide an incinerator in which waste to be disposed feeds to the burning chamber without the aid of a mechanical ram.

SUMMARY

The incinerator includes a substantially circular horizontal burn disk that is rotatably supported within the firebox. Combustible material, which may be bagged, is fed to the burn disk through a chute. Combustion air is forced directly against the slowly rotating burning material through a stationary nozzle extending up through the center of the disk and into the burning material, and through stationary nozzles located around the periphery of the disk to evenly burn the material. Further, air from peripheral nozzles forces unburned material back toward the center of the disk to ensure that it is completely burned. The continual press of bags of combustible material from the chute onto the rotating disk eventually forces ashes and noncombustible material to fall over the rim of the disk for removal.

DRAWINGS

Other objects and advantages of the invention will become apparent upon reading the following detailed description and upon reference to the drawings, in which:

FIG. 1 is an elevation, partially sectioned, of an incinerator embodying the invention.

DESCRIPTION

While the invention will be described in connection with preferred embodiments, it will be understood that I do not intend to limit the invention to those embodiments. On the contrary, I intend to cover all alternatives, modifications and equivalents as may be included within the spirit and scope of the invention as defined by the appended claims.

Turning to FIG. 1, there is shown an incinerator 10 embodying the invention including a furnace or firebox 11 enclosing a burning area 12 and a feeding assembly 13. The firebox 11 includes heat extracting water tubes 16 running from a header (not shown) to a steam drum 18. The lower portion of the firebox 11 forms an ash pit 19 into which ashes and unburnt material fall for collection and removal. A natural draft or a fan 21 vents the upper portion of the firebox 11 to drive gases of combustion and material carried with them to an appropriate cleaner or filtering system.

In accordance with the invention, the burning area 12 includes a horizontal burn disk 22 mounted for rotation in the lower portion of the firebox 11. The feeding assembly 13 includes a feeding chute 24 through which the waste materials to be burned are directed to the upper surface of the burn disk 22. Combustion air is supplied to material on the upper surface of the burn disk 22 through stationary air nozzles 25 located around the periphery of the disk 22. Combustion air may additionally be supplied to the material through a stationary central air nozzle 26 which extends up through the center of the burn disk 22 into the burning material. Ashes and noncombustible materials are pushed off of the edge of the disk 22 by the continual press of burning material on the rotating disk 22.

In order to provide optimum burning conditions, the burn disk 22 is mounted for rotation in the lower section of the firebox 11. The disk 22 may be rotatably driven by any appropriate method from an appropriate power source, such as chain teeth 28 driven by a hydraulic motor 29 as shown in FIG. 1. As the disk 22 rotates, the material between the upper surface of the rotating disk 22 and the stationary feeding chute 24 is constantly agitated and reoriented in the burning area 12. This constant agitation and reorientation ensures that the material will be exposed to sufficient combustion air to perpetuate burning.

Incineration of the combustible material occurs in the burning area 12 directly above the upper surface of the disk 22. In order to retain combustible materials for burning, the horizontal disk 22 has an upperly directed dish shape with a generally flat center section 32 and a upwardly directed rim section 33. One skilled in the art will appreciate that the horizontal disk 22 may be of an alternate design, so long as the burning materials may be retained on the upper surface of the disk 22. The upper surface of the disk 22 is covered with a castable refractory so that the fire holding structure will be long lasting.

Combustible material is supplied directly to the burning area 12 above the disk 22 through a feeding assembly 13. The feeding assembly 13 utilized in the preferred embodiment shown in FIG. 1 is particularly well suited for disposal of contaminated waste in a hospital. Although the feeding assembly 13 described is designed to meet the particular problems associated with disposal of such waste, it will be appreciated that exact configuration and location of the feeding assembly 13 may vary depending on the particular requirements of the application.

The feeding assembly 13 shown in FIG. 1 is situated substantially above the disk 12 so that gravity will feed the material to the upper surface of the disk 12. The feeding assembly 13 includes a vertical feeding chute 24 with an inlet 34 at the upper end of the chute 24. The feeding chute 24 may be provided with a conveyor to transport the bags or other materials to be incinerated to a hopper, or other receiving device (not shown) at the inlet 34. Materials to be incinerated are loaded into the inlet 34 and fed down the feeding chute 24 to the horizontal burn disk 22 due to the force of gravity. One skilled in the art will appreciate that the chute 24 may be of an alternate design, so long as the combustible materials are fed to the surface of the disk 22 by gravity with sufficient compaction that a mechanical ram is unnecessary.

A sealable cover (not shown) may be utilized to prevent smoke or noxious gases from backing up through the feeding chute 24. Such a cover is particularly useful when the incinerator 10 is not operating. During normal operation, the top of the chute 24 will be open to receive materials to be incinerated. In order to prevent gases and smoke from backing up through the feeding chute 24, a negative pressure is maintained in the furnace area. This may be accomplished by a number of different methods. A natural draft may be created by the use of a tall stack (not shown) leading from the incinerator 10 to the outside atmosphere. A negative pressure will be created at the bottom of the stack by virtue of the high temperature gas in the stack. Alternately, in order to create a greater pressure drop, an induced draft fan 21 may be utilized, as shown in FIG. 1.

In order to cool the combustible material located within the feeding chute 24 and prevent ignition before the material reaches the burning area 12, a portion of the feeding chute 24 located within the firebox 11 is surrounded by a plurality of water tubes 38. The water tubes 38 run parallel in a circular array so as to define a cylindrical portion of the chute 24 above the disk 22. Because the tubes 38 run parallel to the flow of material down the chute 24, they will not inhibit the flow of material or prevent natural compaction of the material within the chute 24. Water is circulated through the tubes 38 so that the feeding chute 24 and material to be incinerated are effectively cooled.

The water tubes 38 surrounding the chute 24 as well as the water tubes 16 in the upper portion of the firebox 11 run from a header (not shown) to a steam drum 18 and may be part of a steam generation boiler system (not shown). The steam generated by the boiler system may be used to generate power or heat or for sterilization purposes. Alternately, the boiler system may be used to generate electricity for standby purposes. As water circulates through the tubes 38, 16, within the incinerator 10, the water extracts heat from the air or material adjacent the tubes such that steam is created within the tubes 38, 16. In this way, the additional steam generated by the incinerator 10 may be circulated to the boiler system, which in turn will reduce the fuel costs of the hospital or other facility utilizing the incinerator.

Returning now to FIG. 1, in order to provide for the complete burning of refuse on the burn disk 22, combustion air is provided to the material on the burn disk 22 through tubes ending in air nozzles 25 located around the periphery of the burning area 12. To initially ignite the material being burned, a pilot burner (not shown) is positioned outside of the firebox 11 so as to project a flame into the burning area 12. Once the material is initially ignited, the pilot burner may be turned off; the continued flow of material to be burned from the chute 24 and the continued flow of combustion air, which is jetted into the combustible material from the nozzles 25, will maintain an intense fire.

Combustion takes place around the circumference of the burning area 12 between the nozzles 25 and the rotating disk 22. The nozzles 25 are located at an angle which is roughly normal to the burning surface around the burning area 12. While any number of jets may be provided, in a preferred embodiment, 12 jets are located approximately 30° apart around the periphery of the disk 22. The burning material in front of the nozzle 25 will be continuously reoriented with respect to the incoming air as it is moved and agitated between the stationary feeding chute 24 and the rotating disk 22 to result in optimum burning conditions. The air forced against the burning material additionally cleans off the products of combustion and ash to increase burning efficiency.

In order to further improve combustion, the air nozzles 25 are provided with a secondary air supply. Each air nozzle 25 is situated within a tube 40 which is mounted in the wall of the firebox 11. In accordance with fundamental principals of air flow dynamics, the high pressure nozzle 25 will form a vacuum, or low pressure area around the nozzle 25 where the air is expelled. This low pressure area will pull in secondary air from the area surrounding the nozzle 25 and force it into the fire along with high pressure air. Thus, the secondary air provided through the tube 40 surrounding the nozzle 25 effectively increases the volume of air directed against the burning material without increasing the level of power required to operate an air compressor (not shown) supplying the nozzles 25.

The utilization of secondary air provides a number of additional benefits. The secondary air serves to slow down the high pressure air emitted from the nozzle 25. This reduction in force not only prevents the high pressure air from extinguishing the fire, but intensifies the fire and increases combustion. Further, the primary air pulls in some of the products of combustion, including smoke, as secondary air to force the products back into the central burning area to complete combustion. This further combustion reduces the volume of gases and particulates emitted from the incinerator. Additionally, the products of combustion pulled into the vacuum by the high pressure air heat the combustion air before it reaches the combustion surface. Because this air reaches a temperature above the kindling temperature of most combustible materials, it increases the combustion rate and the completeness of combustion.

In order to increase the penetration of the burning and decrease smoke caused by insufficient air behind the burning mass, the invention provides a second stationary air nozzle 26 that extends upward through the center of the rotating disk 22. The central nozzle 26 is provided with peripheral holes 41 through which air is introduced to the material toward the burning area. Due to both radiation and convection from the fire burning around the periphery of the burning area 12, the material forced down to the center of the disk 22 is above the kindling temperature. As a result, when air is introduced through the central air nozzle 41, the material will burn, even though it is not exposed to the atmosphere.

It will be appreciated that the rate of combustion will be controlled by the volume and force of the combustion air provided to the burning area, the speed of rotation of the burn disk 22, and the amount of compaction of the materials in the feeding chute 24. The air pressure and the rotation speed of the disk 22 may be varied to directly control combustion. The degree of compaction of the material is likewise important to control combustion. If the materials are too highly compacted, the rate of combustion will be greatly reduced. Conversely, if there is very little compaction, the combustion air will blow lighter materials away and reduce burning efficiency. The degree of compaction within the chute 24 is controlled by the weight of the materials loaded within the chute 24 and the physical dimensions of the feeding chute 24. It is contemplated that, in a preferred embodiment of the invention, the distance from the top of the burn disk 22 to the top of the vertical feeding chute 24 will be on the order of 7 to 12 feet; the diameter of the chute 24 will be on the order of 24 to 36 inches.

As the material burns on the burn disk 22, ash will be formed around the periphery of the rotating disk 22. The combustible material continually forced down into the burning area 12 will push the ash radially outward and off the edge of the disk 22. Any noncombustible materials such as needles, glass, cans, etc., will likewise be pushed radially outward and off the edge of the rotating disk 22. In order to collect the ash and noncombustible material for disposal, the incinerator is provided with an ash pit 19 below the disk 22. The ash and other noncombustible material may be removed from the ash pit 19 through doors 44 located around the firebox 11. Although not illustrated, it will be appreciated that a finger or other rotating device may be provided to move the ash to the deepest area of the ash pit so that the ash and noncombustible materials may be removed at a single location.

In summary, the invention provides a low volume water cooled incinerator. Material, which may be bagged, medically contaminated waste, is introduced to a burn disk through a feeding chute. Combustion air is introduced through a stationary nozzle to the outer surface of the burning material. Combustion air may be likewise be introduced to the lower surface of the burning material through a central stationary air nozzle extending up through the center of the rotating disk into the burning material. Ash and noncombustible materials are pushed out off the edge of the burn disk or burning chamber for disposal.

I claim:

1. An incinerator for burning combustible material comprising, in combination, a firebox, a horizontal substantially circular burning disk rotatably supported in said firebox, a combustion zone substantially immediately above the upper surface of the disk, means for rotating said disk, means for supplying compacted material to the disk, a combustion air supply extending into said firebox and ending at a central nozzle extending upward through the center of the disk and at least one peripheral nozzle located along the periphery of the disk above the upper surface of the disk, said central nozzle having means for directing air into the combustion zone in a direction substantially horizontal to the upper surface of the disk, and said peripheral nozzle directed to drive air into the combustion zone, such that rotation of the disk exposed unburnt surfaces of the compacted material to combustion air whereby the combustible compacted material burns substantially completely.

2. The incinerator as claimed in claim 1 wherein said peripheral nozzles are located at approximately 30° increments around the disk.

3. The incinerator as claimed in claim 1 further comprising at least one tube, the peripheral nozzle extending through said tube.

4. An incinerator as claimed in claim 1 wherein said means for supplying compacted material to the disk is a chute of height sufficient to effect the compaction under the influence of gravity.

5. An incinerator fur burning combustible material comprising, in combination, a firebox, a horizontal substantially circular burning disk rotatably supported in said firebox, a combustion zone substantially immediately above the upper surface of the disk, means for rotating said disk, a chute having at least a section which is substantially vertical, the uppermost end of the chute opening outside of the firebox and the lowermost end of the chute opening adjacent the combustion zone, said chute being of a height sufficient to effect compaction of the material under the influence of gravity so that material deposited in the uppermost end of the firebox advances through the chute, is compacted under the influence of gravity and emerges from the chute into the combustion zone on the top of the disk, a combustion air supply extending into said firebox and ending at a central nozzle extending upward through the center of the disk and at least one peripheral nozzle located along the periphery of the disk above the upper surface of the disk, said central nozzle having means for directing air into the combustion zone in a direction substantially horizontal to the upper surface of the disk, and said peripheral nozzle directed to drive air into the combustion zone, such that the compacted material in the combustion zone is a agitated between the chute and the rotating disk whereby unburnt surfaces of the compacted material are exposed to combustion air and the combustible compacted material burns substantially completely.

6. An incinerator as claimed in claim 5 further comprising at least one tube, the peripheral nozzle extending through said tube.

7. The incinerator as claimed in claim 4 further comprising a plurality of water carrying tubes located in the firebox around the chute and above the disk, and a water circulation system including a header and a steam drum connected to said tubes so as to carry water through the header and the tubes to the steam drum.

8. The incinerator as claimed in claim 5 further comprising a plurality of water carrying tubes located in the firebox around the chute and above the disk, and a water circulation system including a header and a steam drum connected to said tubes so as to carry water through the header and the tubes to the steam drum.

9. The incinerator as claimed in claim 7, wherein the plurality of water carrying tubes further surrounds the chute.

10. The incinerator as claimed in claim 8, wherein the plurality of water carrying tubes further surrounds the chute.

11. The incinerator as claimed in claim 1 wherein the disk is protected on top by a castable refractory material.

12. The incinerator as claimed in claim 5 wherein the disk is protected on top by a castable refractory material.

13. The incinerator as claimed in claim 1 wherein the means for rotating the disk is adjustable so that the speed of rotation may be varied.

14. The incinerator as claimed in claim 5 wherein the means for rotating the disk is adjustable so that the speed of rotation may be varied.

15. The incinerator as claimed in claim 1 further comprising an ash pit located beneath the disk to catch ash and unburnt materials which fall off the edge of the disk, and a means for removing the ash and unburnt materials from the ashpit.

16. The incinerator as claimed in claim 5 further comprising an ash pit located beneath the disk to catch ash and unburnt materials which fall off the edge of the disk, and a means for removing the ash and unburnt materials from the ashpit.

17. The incinerator as claimed in claim 15, wherein the means for removing the ash and unburnt material includes means for moving the ash and unburnt material to the deepest area of the ashpit.

18. The incinerator as claimed in claim 16, wherein the means for removing the ash and unburnt material includes means for moving the ash and unburnt material to the deepest area of the ashpit.

19. The incinerator as claimed in claim 7, wherein at least the lower portion of the chute comprises a plurality of water carrying tubes, said water carrying tubes being stationary and disposed vertically whereby the material in the combustion zone is agitated between the stationary tubes and the rotating disk.

20. The incinerator as claimed in claim 8, wherein at least the lower portion of the chute comprises a plurality of water carrying tubes, said water carrying tubes being stationary and disposed vertically whereby the material in the combustion zone is agitated between the stationary tubes and the rotating disk.

21. The incinerator as claimed in claim 1 wherein the compacted material in the combustion zone is substantially adjacent a stationary portion of the means for supplying, such that the material is agitated between the stationary portion and the rotating disk.

* * * * *

UNITED STATES PATENT AND TRADEMARK OFFICE

CERTIFICATE OF CORRECTION

PATENT NO. : 4,976,208

DATED : December 11, 1990

INVENTOR(S) : CHADWELL O'CONNOR

It is certified that error appears in the above-identified patent and that said Letters Patent is hereby corrected as shown below:

ON THE TITLE PAGE:

[76] Inventor, Chadwell O'Connor's residence, delete "Galazy" and substitute therefor -- Galaxy --.

[57] ABSTRACT, in the second sentence, which begins "Compacted material for burning", delete "througha" and substitute therefor -- through a --.

Col. 6, line 15, delete "exposed" and substitute therefore -- exposes --.

Col. 6, line 57, delete the word "a".

Signed and Sealed this

First Day of June, 1993

*Attest:*

Michael K. Kirk

MICHAEL K. KIRK

*Attesting Officer*

*Acting Commissioner of Patents and Trademarks*